US006854148B1

(12) United States Patent
Rief et al.

(10) Patent No.: US 6,854,148 B1
(45) Date of Patent: Feb. 15, 2005

(54) FOUR-WHEEL-DRIVE AUTOMATIC SWIMMING POOL CLEANER

(75) Inventors: Dieter J. Rief, Santa Rosa, CA (US); Manuela Rief, Santa Rosa, CA (US)

(73) Assignee: Poolvernguegen, Santa Rosa, CA (US)

( * ) Notice: Subject to any disclaimer, the term of this patent is extended or adjusted under 35 U.S.C. 154(b) by 0 days.

(21) Appl. No.: 10/296,778

(22) PCT Filed: May 26, 2000

(86) PCT No.: PCT/US00/14771

§ 371 (c)(1),
(2), (4) Date: Nov. 26, 2002

(87) PCT Pub. No.: WO01/92664

PCT Pub. Date: Dec. 6, 2001

(51) Int. Cl.[7] ..... E04H 4/16
(52) U.S. Cl. ..... 15/1.7
(58) Field of Search ..... 15/1.7; 210/169

(56) References Cited

U.S. PATENT DOCUMENTS

| | | | | |
|---|---|---|---|---|
| 3,439,368 A | | 4/1969 | Myers | |
| 3,959,838 A | * | 6/1976 | Hannah | 15/1.7 |
| 5,001,800 A | | 3/1991 | Parenti et al. | |
| 5,172,445 A | | 12/1992 | Chandler | |
| 5,197,158 A | * | 3/1993 | Moini | 15/1.7 |
| 5,245,723 A | | 9/1993 | Sommer | |
| 5,933,899 A | | 8/1999 | Campbell et al. | |
| 6,131,227 A | | 10/2000 | Rief et al. | |
| 6,292,970 B1 | | 9/2001 | Rief et al. | |

FOREIGN PATENT DOCUMENTS

| | | |
|---|---|---|
| EP | 0 323 883 | 1/1989 |
| EP | 0 565 226 | 2/1993 |
| WO | WO 01/92664 | 12/2001 |

* cited by examiner

*Primary Examiner*—Robert J. Warden, Sr.
*Assistant Examiner*—Laura C Cole
(74) *Attorney, Agent, or Firm*—Jansson, Shupe & Munger, Ltd.

(57) ABSTRACT

A four-wheel pool cleaner (20) motivated by water flow to move along a pool surface, and having: a body (24); the four wheels rotatably mounted thereon and including two sets of two wheels (22) each, one wheel of each set on each side; a drive mechanism (36) in position to be moved by water flow and having a rotatable drive member (76); a drive train extending to the first wheel set (22*a, b*) and to the second wheel set (22*c, d*), to drive all four wheels. Preferred embodiments include: wheel-to-wheel drive links (88) along the side; a turbine (36) as drive mechanism; a pair of spaced wheelgears (32, 34), preferably integrally formed with the wheel, facilitating drive linkages and steering; a pair of end-to-end drive shafts (80, 82) joined by a coupler (84*c*), one shaft end (80*a*) being a ball joint allowing fore-and-aft movement of a drive-shaft distal end; a spring (102) and cam (100) for alternately moving that distal end between a driving position engaging one of the spaced wheelgears (32), and a steering position engaging the other of the spaced wheelgears (34); wheel treads (108) with radial fingers (110), some (110*a–c*) of longer length; and a segmented articulated skirt (56) to help enclose a plenum beneath the pool cleaner.

29 Claims, 8 Drawing Sheets

FOUR-WHEEL-DRIVE AUTOMATIC SWIMMING POOL CLEANER

FIELD OF THE INVENTION

The present invention relates to swimming pool cleaners and, more particularly, to automatic pool cleaners driven by the flow of water therethrough for purposes of cleaning. Still more particularly, the invention relates to wheeled automatic swimming pool cleaners.

BACKGROUND OF THE INVENTION

Automatic swimming pool cleaners of the type that move about the underwater surfaces of a swimming pool are driven by many different kinds of systems. A variety of different pool cleaner drive devices in one way or another harness the flow of water, as it is drawn (or in some cases pushed) through the pool cleaner by the pumping action of a remote pump for debris collection purposes, to create forward pool cleaner movement. Some of the many kinds of water-driven automatic pool cleaners are those driven in various ways by turbines, which translate water movement into rotational motion, and those driven in various ways by oscillators, which move back and back and forth by virtue of Bernoulli's principle, a motion which can be converted into intermittent unidirectional rotation and harnessed in various ways.

Various water-driven automatic pool cleaners of the prior art are four-wheel structures supported on underwater surfaces by wheels. Wheel rotation by linkage to a turbine or other drive mechanism causes propulsion in such prior art devices. Various problems and shortcoming exist in such prior devices.

Among the problems and shortcomings not adequately addressed are failures of certain kinds of cleaners to provide complete cleaning coverage. Obtaining complete coverage is particularly difficult or problematic for swimming pools having certain kinds of surfaces, surface shapes or obstacles. Complete coverage, and thus satisfactory cleaning, are difficult to obtain when the pumping pressure generated by the pump is weak, such that the driving force of a pool cleaner is seriously diminished. Various automatic pool cleaners of the prior art have insufficient speed and strength of movement, and this creates and exacerbates problems of weak cleaning ability. Some problems, failures or difficulties occur when pool cleaners get hung up or caught at an area where its driving wheels are unable to contact the underwater pool surfaces, or are at least unable to engage such surfaces with sufficient traction to allow movement of the pool cleaner. For some cleaners of the prior art, steering (that is, the motions taken by pool cleaners in order to change directions) can be problematic, particularly on certain kinds of surfaces and when speed is low and the steering and propulsion forces that are generated are low.

Various advances have been made over the years, but there remains a need for an automatic water-driven pool cleaner, particularly of wheeled kind, having improved function in movement and in cleaning ability.

OBJECTS OF THE INVENTION

It is an object of this invention to provide an improved automatic swimming pool cleaner, particularly of the water-driven type, overcoming some of the problems and shortcomings of the prior art.

Another object of this invention is to provide an improved wheeled automatic swimming pool cleaner of the water-driven type.

Another object is to provide an improved wheeled automatic swimming pool cleaner of the water-driven type has excellent driving force along underwater pool surfaces.

Another object of the invention is to provide an improved wheeled automatic swimming pool cleaner of the water-driven type which has excellent traction in a variety of situations.

Still another object of the invention is to provide an improved wheeled automatic swimming pool cleaner of the water-driven type which has excellent ability to traverse pool surfaces of different types and hard-to-reach pool areas.

Yet another object of the invention is to provide an improved automatic pool cleaner of the water-driven type exhibiting excellent cleaning ability.

Another object of the invention is to provide an improved wheeled automatic swimming pool cleaner of the water-driven type which generates good driving power even when used with pool pumping systems generating low pumping pressures.

Another object of the invention is to provide an improved wheeled automatic swimming pool cleaner which resists any tendency to become hung up and is capable of extracting itself from situations in which there is a lack of traction.

Still another object is to provide an improved automatic swimming pool cleaner with excellent speed and steering (direction-changing) capabilities.

These and other objects of the invention will be apparent from the following descriptions and from the drawings.

SUMMARY OF THE INVENTION

This invention is an improved automatic swimming pool cleaner of the type motivated by water flow through it to move along a pool surface to be cleaned, and of the particular type having four wheels in contact with the underwater pool surfaces. The invention, including in its preferred embodiments, overcomes various problems and shortcomings of the prior art, including those referred to above.

The automatic swimming pool cleaner of this invention provides important advantages, including the following: excellent driving force along underwater surfaces; excellent traction in a variety of situations; an ability to traverse pool surfaces of different types and hard-to-reach pool areas; excellent cleaning coverage of underwater surfaces; effective pool cleaner operation at low pressure; good speed and power, even at low pressures; reliable take-up of debris; highly-reliable steering; an ability to avoid and/or escape situations involving hang-up of the pool cleaner; and good adaptability to desired variations in cleaner structure.

The inventive automatic pool cleaner includes: a body having a front, a rear and opposite sides; four wheels rotatably mounted with respect to the body and including first and second sets of two wheels each, each set having one wheel on each side of the body; a drive mechanism secured with respect to the body in position to be activated by the flow of water through the pool cleaner, the drive mechanism including a rotatable drive member; drive train from the drive member to the first set of wheels and to the second set of wheels, such that all four wheels are driven.

In preferred embodiments, the drive train includes a first drive-train portion from the drive member to the first set of wheels, a second drive-train portion from one wheel of the first set to one wheel of the second set, and a third drive-train portion from to the other wheel of the first set to the other wheel of the second set.

In preferred embodiments the drive mechanism is a turbine including a turbine rotor secured to the body in position to be rotated by the flow of water. The drive member is secured with respect to the rotor and is rotatable with the rotor.

Highly preferred embodiments of the type having turbines as drive mechanisms include: a turbine housing secured to the body and having a water-flow chamber formed by a chamber wall, the chamber having inlet and outlet ports; the turbine rotor being rotatably mounted in the chamber; and turbine vanes having proximal ends connected to the rotor and distal ends which are movable between extended positions adjacent to the wall and retracted positions spaced from the wall and closer to the rotor, in order to allow passage of debris pieces of substantial size through the turbine.

Preferably, the vanes are pivotably mounted with respect to the rotor. The vanes are preferably curved and the distal edges of the vanes are able to contact the chamber wall in at least some of their extended positions. In highly preferred embodiments of this type, the rotor has an exterior surface beneath which, for each vane, is a corresponding cavity which pivotably holds the proximal edge of the vane. The vanes preferably have enlargements at their proximal edges sized for free insertion into, and pivotable engagement in, the cavities.

These highly preferred forms of turbines are the subject of U.S. Pat. No. 6,292,970, entitled "Turbine-Driven Automatic Swimming Pool Cleaners," filed by Dieter J. Rief and Manuela Rief, both inventors herein, and Rosemarie Rief, on May 23, 2000.

While the drive mechanism included in the pool cleaner of this invention is preferably a turbine, and most preferably a turbine having the preferred features just described, the drive mechanism can be other kinds of devices capable of rotating a drive member. For example, oscillating drive mechanisms which utilize Bernoulli's principle to establish and maintain oscillation of an oscillator may be used. As is known to those skilled in the art, oscillating rotation can be translated into intermittent unidirectional rotation by ratcheting devices or otherwise; thus, oscillators can drive the rotatable drive member referred to above.

Each of the four wheels, of course, has an inward side and an outward side depending upon how it is mounted on the pool cleaner. In preferred embodiments of this invention, the first wheel of the first set has radially-spaced primary and secondary wheelgears on its inward side, such wheelgears facing one another, and the second wheel of the first set has another primary wheelgear on its inward side, the primary wheelgears on the two wheels of the first set being similar to one another. Preferably, the drive train terminates at the first and second wheels of the first set in first and second drive pinions, respectively, each engaging the primary wheelgear of the respective wheel of such set; this serves to drive the wheels of the first set in the forward direction synchronously, in contact with the underwater pool surface.

In such embodiments, it is highly preferred that the wheelgears of the first wheel of the first set be concentric with one another, and integrally formed with the first wheel itself. The wheelgear of the second wheel of the first set is also preferably integrally formed with the second wheel. Most preferably, the first and second wheels of the first set are identical, and therefore interchangeable.

As used herein, the term "wheelgear" refers to any gear which is affixed on, or formed as part of, a swimming pool cleaner wheel which contacts the surface of the pool to propel the pool cleaner.

In preferred embodiments, each of the wheels of the second set of wheels has what is being called a "final" wheelgear on its outward side. In such embodiments, each of the second and third drive-train portions mentioned above includes a transfer shaft journaled with respect to the body, a first transfer pinion engaged with one of the primary wheelgears, and a second transfer pinion engaged with one of the final wheelgears. By virtue of these drive-train portions, the wheels of the first set impart their rotation of the wheels of the second set. Preferably, each transfer shaft itself forms the first and second transfer pinions at the opposite ends thereof.

It is preferred that all four wheels, including the second set each of which has a "final" wheelgear on it, have their wheelgears integrally formed with the wheel. Most preferably, all four wheels are identical and completely interchangeable.

In preferred embodiments, the drive member is a drive gear and the drive train includes first and second drive shafts which are journaled with respect to the body and which have proximal and distal ends. In such embodiments, the first and second drive pinions, mentioned above, are driven by the first and second drive shafts, respectively, and the drive train is a gear train from the drive gear to the first and second drive shafts. Preferably, the first and second drive shafts form the first and second drive pinions, respectively, at their distal ends.

The drive train preferably includes a coupler with opposite ends receiving the proximal ends of the first and second drive shafts. The proximal end of the first drive shaft is a ball joint which allows the first drive shaft to be pivoted off-axis. This allows the distal end of the first drive shaft to be moved fore-and-aft between a driving position, in which the first drive pinion engages the primary wheelgear of the first wheel of the first set, and a steering position, in which the first drive pinion engages the secondary wheelgear of such first wheel. This movement, from engagement with a wheelgear in the form of a ring gear (i.e., with radially inwardly-facing teeth) to engagement with a wheelgear having radially outwardly-facing teeth, causes the first wheel of the first set to change its direction of rotation—i.e., to rotate in a direction opposite that of the second wheel of the first set. This interrupts the synchronous rotation of the wheels on the pool surface, and causes turning of the pool cleaner.

Highly preferred embodiments include apparatus to achieve the fore-and-aft movement of the distal end of the first drive shaft. Such apparatus preferably includes: a shift bracket assembly which is slidably held by the body and has the first drive shaft journaled in it for distal-end movement between the driving and steering positions; a cam wheel rotatably secured with respect to the body and engaging the shift bracket assembly, the cam wheel having portions of greater and lesser radii; a reduction gear assembly secured to the body and linking the drive mechanism with the cam wheel such that rotation of the cam wheel is related to rotation of the drive member; and a spring which is positioned and supported to bias the shift bracket toward the cam wheel. By virtue of this apparatus the cam wheel, acting through the shift bracket assembly, alternately holds the distal end of the first drive shaft in the driving position and allows the distal end of the first drive shaft to move to the steering position.

In highly preferred embodiments, the wheels have treads with a multiplicity of outwardly extending radial fingers. It is most preferred that a small subset of the radial fingers (extending along a very small sector of the wheel) project radially farther than the other fingers. With this embodiment, if the pool cleaner for any reason is hung up on some obstruction or pool surface feature, the longer treads, when they come around, tend to provide traction for dislodgement purposes.

In certain preferred embodiments, the aforementioned water inlet faces the surface of the pool and the pool cleaner includes a skirt secured with respect to the body and extending toward the pool surface such that the skirt and the body, together with the pool surface, form a plenum from which water and debris are drawn into the inlet. The skirt is formed of at least one flap member which has upper and lower articulating portions, the upper articulating portion having a proximal end hinged to the body and a distal end hinged to the lower articulating portion. Most preferably, the skirt is segmented in that it is formed of a plurality of the articulated flap members in side-by-side arrangement, each having upper and lower articulating portions.

Such skirt, which is the subject of commonly-owned copending U.S. Pat. No. 6,131,227, entitled "Suction-Regulating Skirt for Automated Swimming Pool Cleaner Heads," filed by Dieter J. Rief, an inventor herein, and Hans Raines Schlitzer on May 21, 1999, facilitates relative enclosure of the plenum despite encountered irregularities in the pool surface immediately under the pool cleaner. As water is drawn into the turbine chamber through the inlet, the skirt minimizes the openness between the pool cleaner body and the underwater surface of the pool, and this causes a speed-up in the linear flow of water immediately along the underwater surface of the pool, at positions under the pool cleaner. Such speed-up of linear flow improves the ability of the pool cleaner to ingest debris along with water, so that the debris tends to move easily into the turbine chamber, and from there through the outlet and into a bag or other collector.

In certain preferred forms, the inventive automatic pool cleaners are suction cleaners. In other preferred forms, the inventive automatic pool cleaners are pressure cleaners. Certain highly preferred forms of swimming pool pressure cleaners are the subjects of PCT Patent Application No. PCT/US00/14770, entitled "Swimming Pool Pressure Cleaner with Internal Steering Mechanism," concurrently filed by the applicant herein on an invention of Dieter J. Rief and Manuela Rief, the inventors herein.

While the drive mechanism included in the pool cleaner of this invention is preferably a turbine, and most preferably a turbine having the particular features referred to above, the drive mechanism can be other kinds of devices which are capable of rotating a drive member. For example, oscillating drive mechanisms which utilize Bernoulli's principle to establish and maintain oscillation of an oscillator may be used. As is known to those skilled in the art, oscillating rotation can be translated into intermittent unidirectional rotation by ratcheting or other devices; thus, oscillators can drive the rotatable drive member referred to above.

DETAILED DESCRIPTION OF PREFERRED EMBODIMENTS

FIGS. 1–9 illustrate a preferred automatic swimming pool cleaner 20 in accordance with this invention. Pool cleaner 20 has four identical drive wheels marked by numeral 22, including left front drive wheel 22*a,* right front drive wheel 22*b,* and left and right rear drive wheels 22*c* and 22*d.* All four drive wheels are driven to provide forward movement of pool cleaner 20. Rear drive wheels 22*c* and 22*d* are driven by separate linkages from front wheels 22*a* and 22*b,* respectively.

Left front drive wheel 22*a,* which is normally driven in a forward direction, is periodically temporarily driven in a reverse direction. When this occurs, left rear drive wheel 22*c* is also driven in a reverse direction by virtue of the linkage between drive wheels 22*a* and 22*c.* During such brief intermittent periods of reverse rotation, the direction of travel of pool cleaner 20 changes. This steering function, together with the power provided by four-wheel drive of this invention, provides excellent cleaning coverage of underwater pool surfaces.

Figure 1:
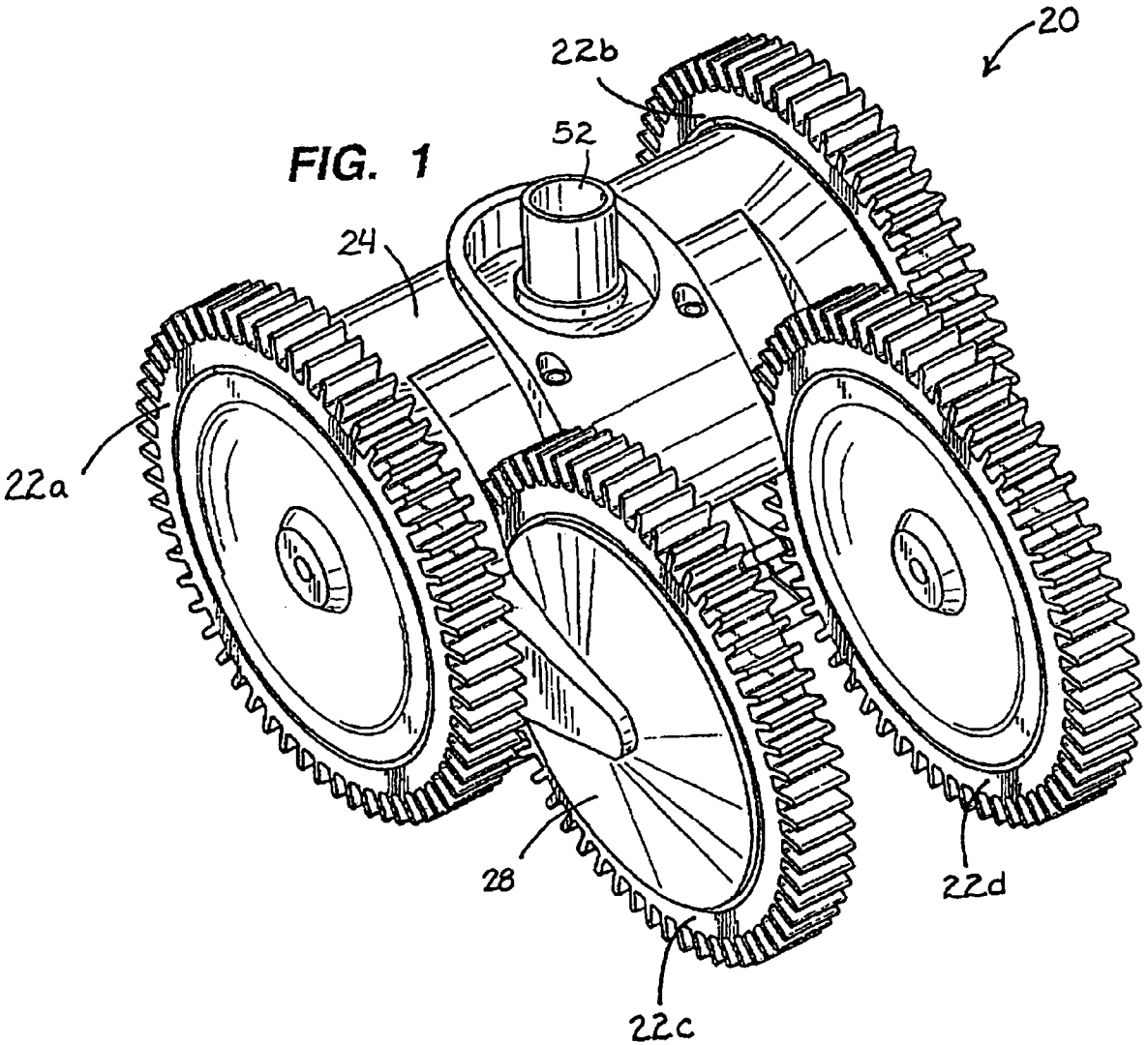
FIG. 1 is a perspective view of a preferred automatic pool cleaner in accordance with this invention, taken generally from the rear. The device is a suction cleaner.
Figure 2:
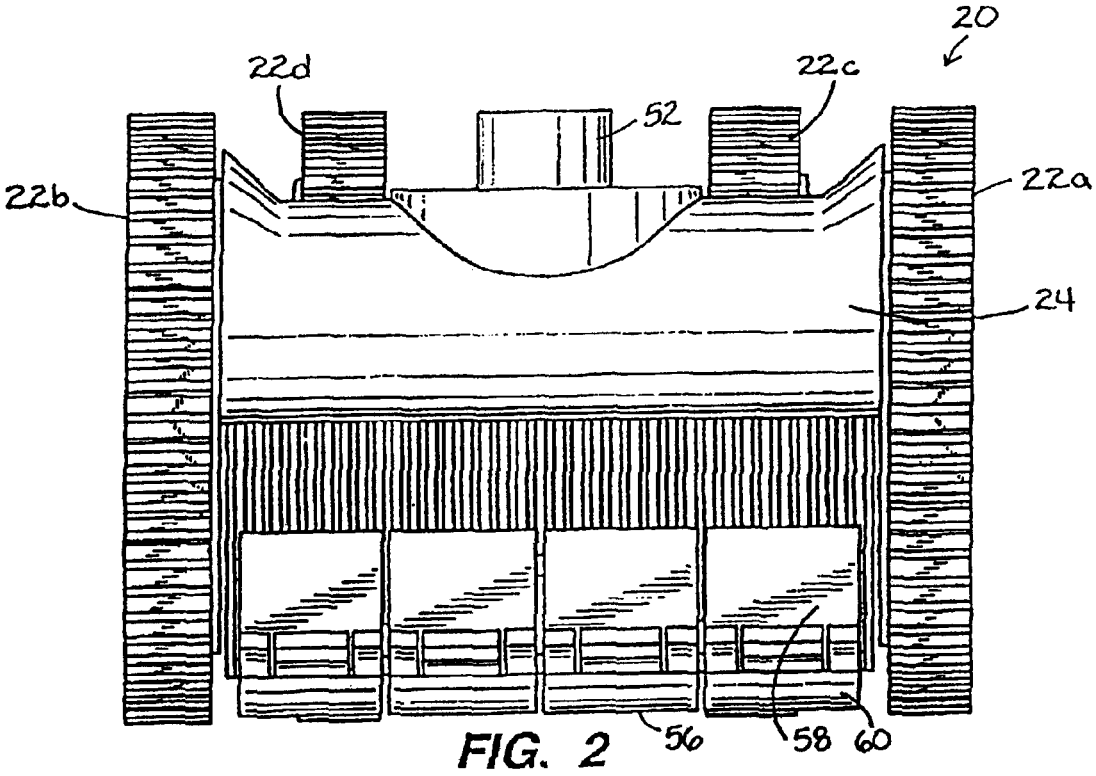
FIG. 2 is a front elevation of the device of FIG. 1.
Figure 4:
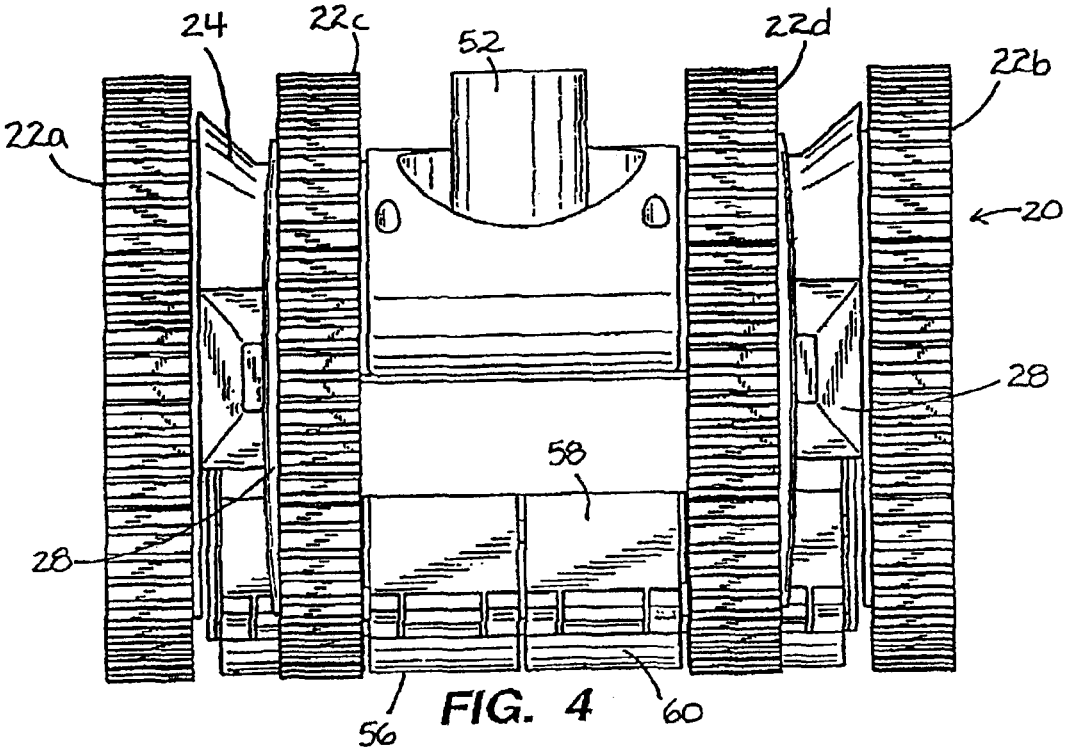
FIG. 4 is a rear elevation of the device of FIG. 1.
Figure 3:
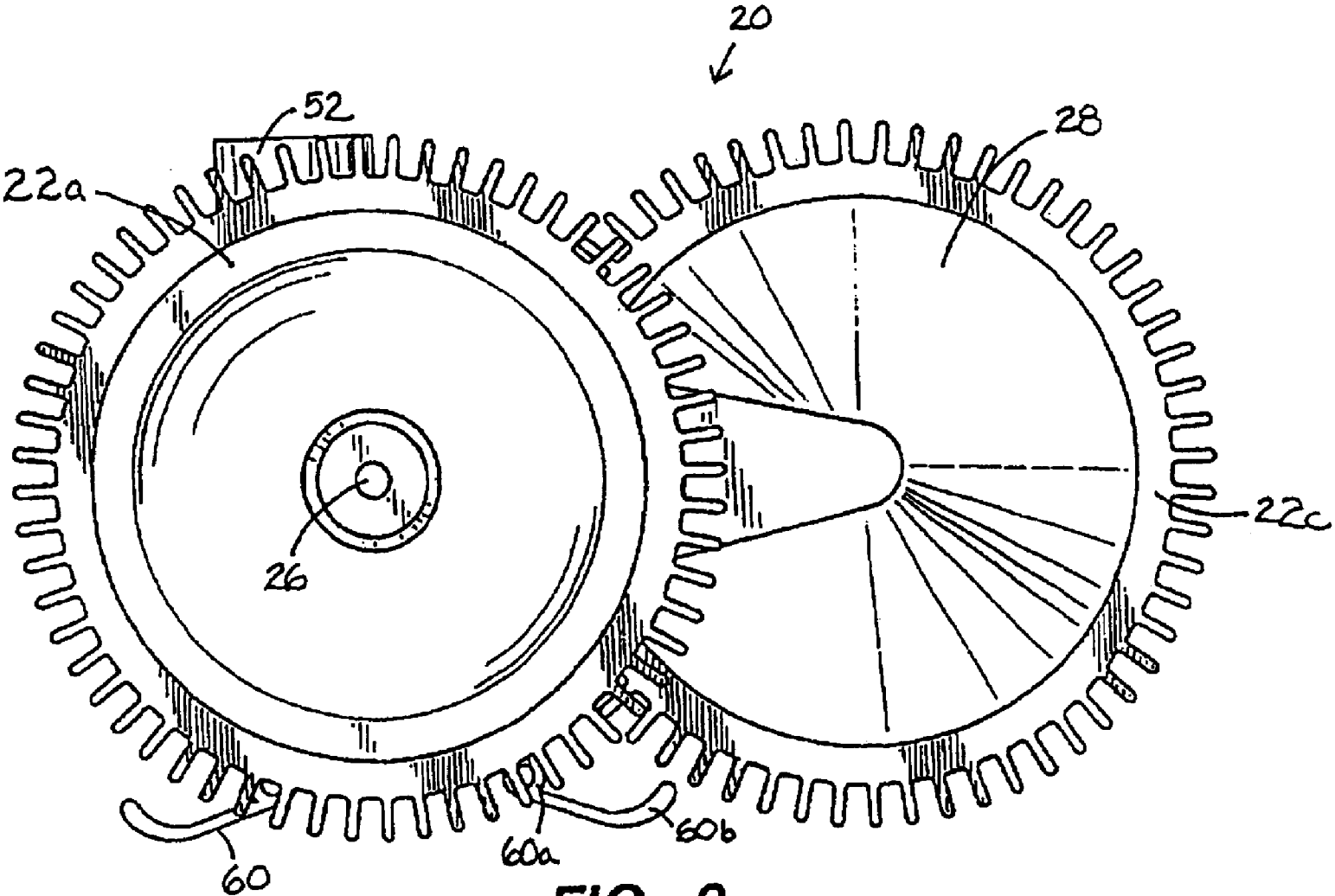
FIG. 3 is a left side elevation of the device of FIG. 1.
Figure 5:
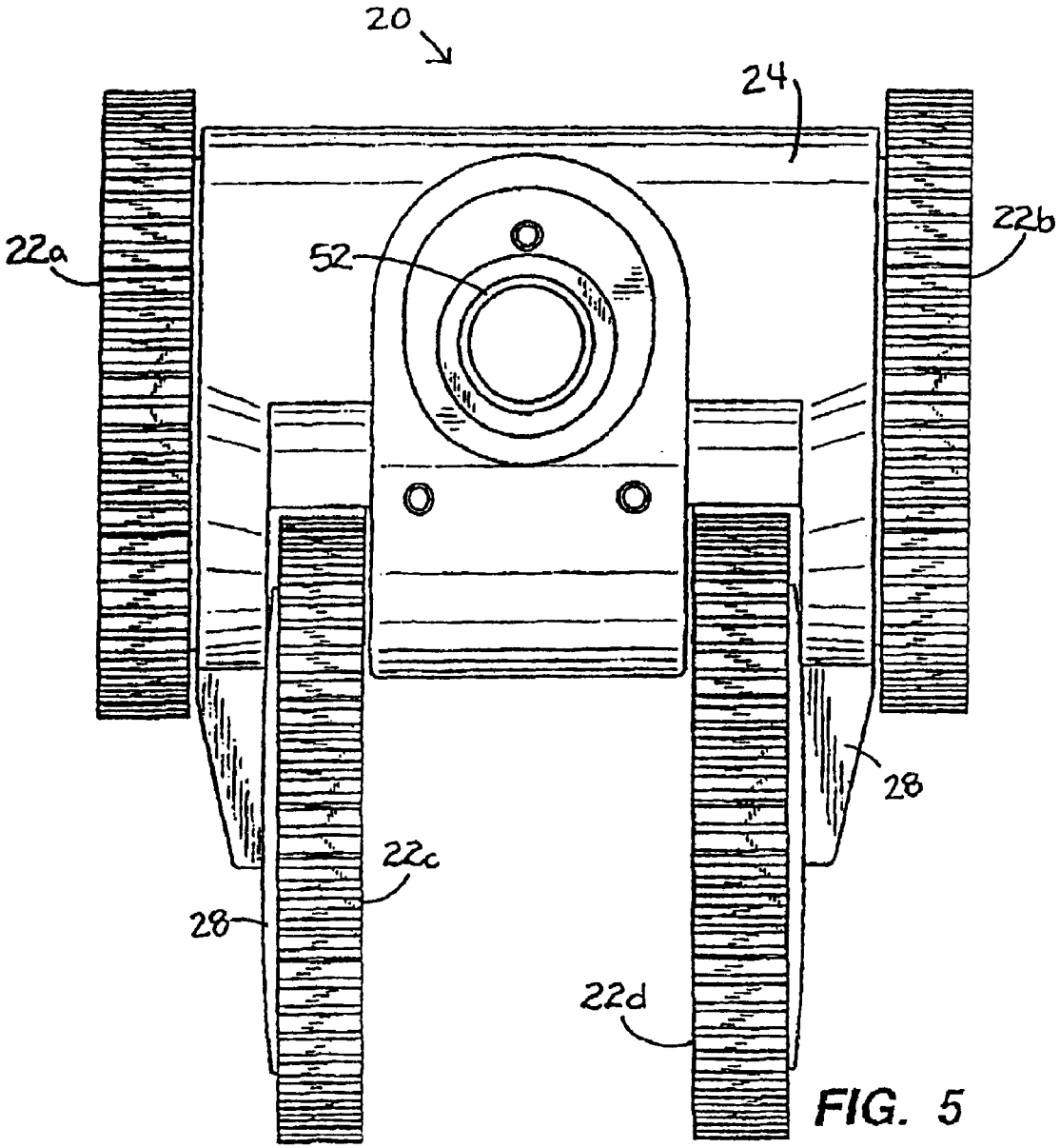
FIG. 5 is a top plan view of the device of FIG. 1.
Figure 6:
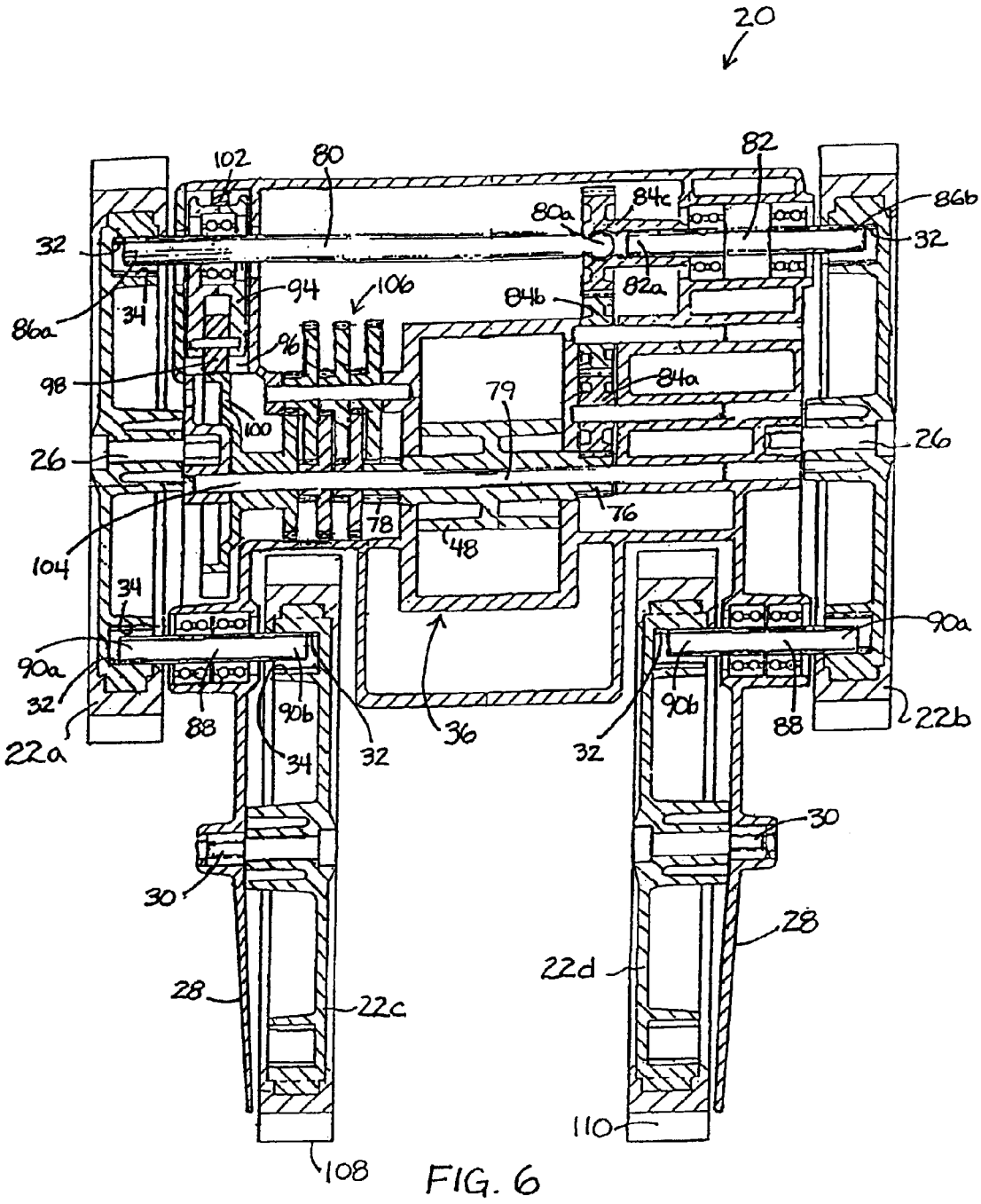
FIG. 6 is a detailed top sectional of the device of FIG. 1.

Pool cleaner 20 includes a body 24 which is preferably formed of two or more plastic pieces designed to accommodate the parts and features of the invention. Front drive wheels 22*a* and 22*b* are rotatably mounted with respect to body 24 on wheel shafts 26, as shown in FIG. 6. Attached to body 24 are rear wheel supports 28, and rear wheels 22*c* and 22*d* are rotatably mounted thereon by wheel shafts 30. Front wheels 22*a* and 22*b* have gearing (hereafter described) on their inward surfaces, i.e., the surfaces facing each other. Rear wheels 22*c* and 22*d* have the same gearing on their outward surfaces. Drive wheels 22*a–d* are identical to each other, and thus are interchangeable.

The gearing on wheels 22*a–d* includes concentric radially-spaced primary and secondary wheelgears 32 and 34. Primary and secondary wheelgears 32 and 34 are radially spaced from one another by a distance in excess of the diameter of a pinion gear (hereafter described) which alternately engages such gears on drive wheel 22*a.* While all wheels are interchangeable, only drive wheel 22*a* uses both wheelgears, on drive wheels 22*b–d,* only wheelgear 32 is used.

Pool cleaner 20 includes a drive mechanism which utilizes the flow of water through the pool cleaner to create rotary motion which is transferred to the wheels by a drive train. More specifically, pool cleaner 20 includes a turbine 36, part of which, notably turbine housing 38, is secured to body 24. (As used with respect to turbine housing 38 and body 24, the term "secured to" includes having been formed together.)

Turbine housing 38 has a chamber 40 in it which is formed by a chamber wall 42. Chamber 40 includes an inlet port 44 and an outlet port 46. Turbine 36 also includes a rotor 48, which is rotatably mounted within chamber 40, and a number of turbine vanes 50, each of which has proximal and distal edges 50*a* and 50*b*. Proximal edge 50*a* of each vane 50 is generally cylindrical in shape and is loosely received within a generally cylindrical void in rotor 48, formed just below the outer surface of the rotor. Thus, vanes 50, which are of a curved configuration, freely move between fully extended positions in which they contact chamber wall 42 and retracted positions in which their distal edges 50*b* are closer to rotor 48 and spaced from chamber wall 42. This provides free adjustability of vanes 50 to allow large pieces of debris to pass through chamber 40 without interfering with operation of the turbine.

Figure 7:
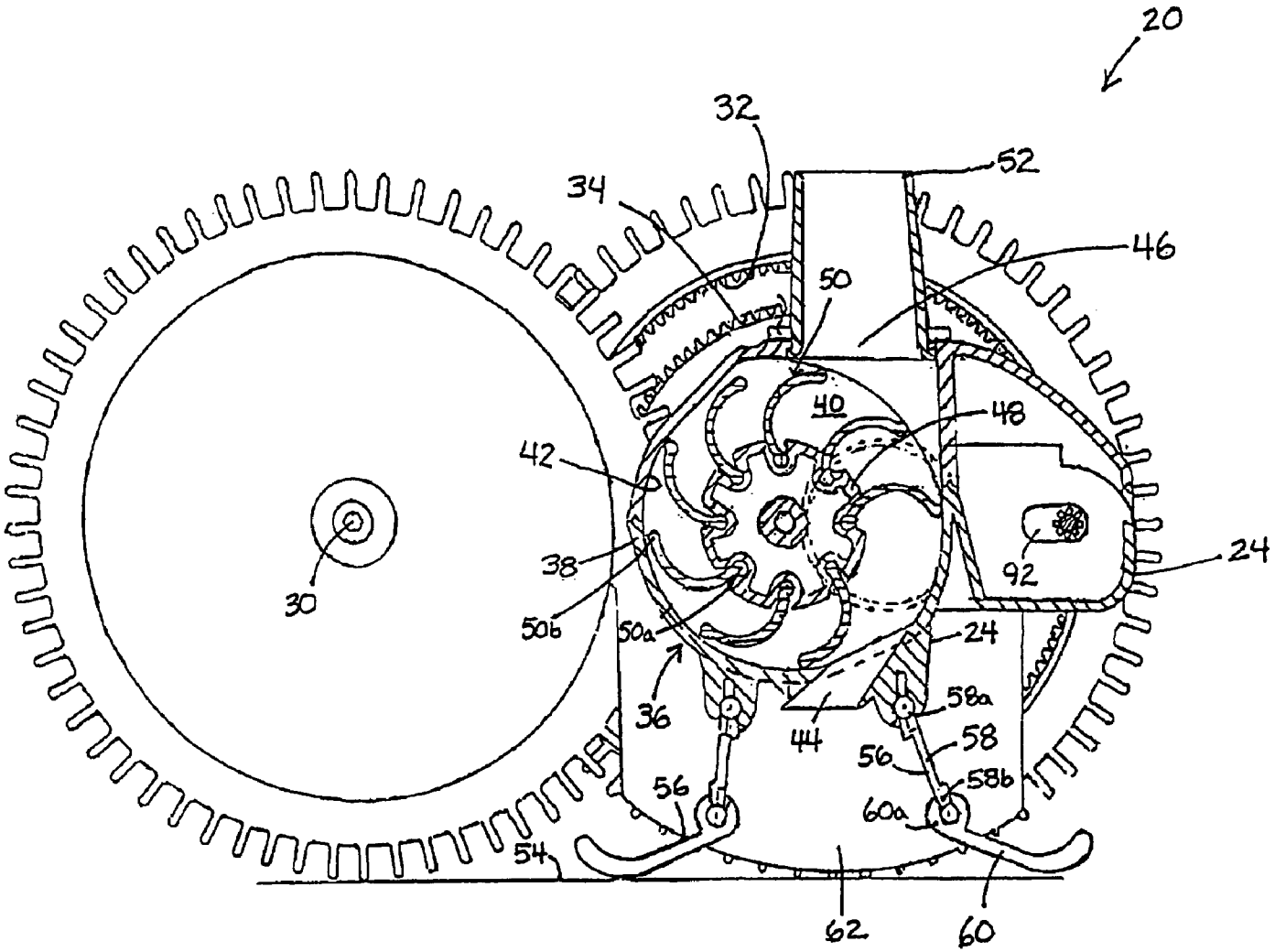
FIG. 7 is a side sectional taken along stepped section 7—7 as indicated in FIG. 6, but with certain parts and details not included to enhance clarity.

Turbine 36, shown in FIG. 7, serves two functions, providing power to drive wheels 22*a–d* through linkages (hereafter described) and providing power for operation of a steering device (hereafter described), both of which occur as water and debris are drawn through it by the action of a remote pump. A flexible hose (not shown) is rotatably attached to hose coupling 52 (in known fashion) and draws water from beneath pool cleaner 20 through inlet port 44, turbine 36 and outlet port 46.

Beneath pool cleaner 20, water inlet port 44 faces the pool surface 54. Pool cleaner 20 includes a segmented skirt which has forward and rearward portions, each of which includes a number of flap members 56 arranged in side by side relationship. Together, flap members 56 and body 24 form a plenum 62. Each flap member 56 includes an upper articulating portion 58 and a lower articulating portion 60. Upper portion 58 has a proximal end 58*a* which is hinged to body 24 and a distal end 58*b* which is hinged to a proximal end 60*a* of upper portion 60. By virtue of this design, flap members 56 self-adjust to the contours of the pool surface 54. Flap members 56 serve to keep plenum 62 substantially closed, which provides flow characteristics favorable for collection of debris from beneath pool cleaner 20 by the suction action.

Figure 10:
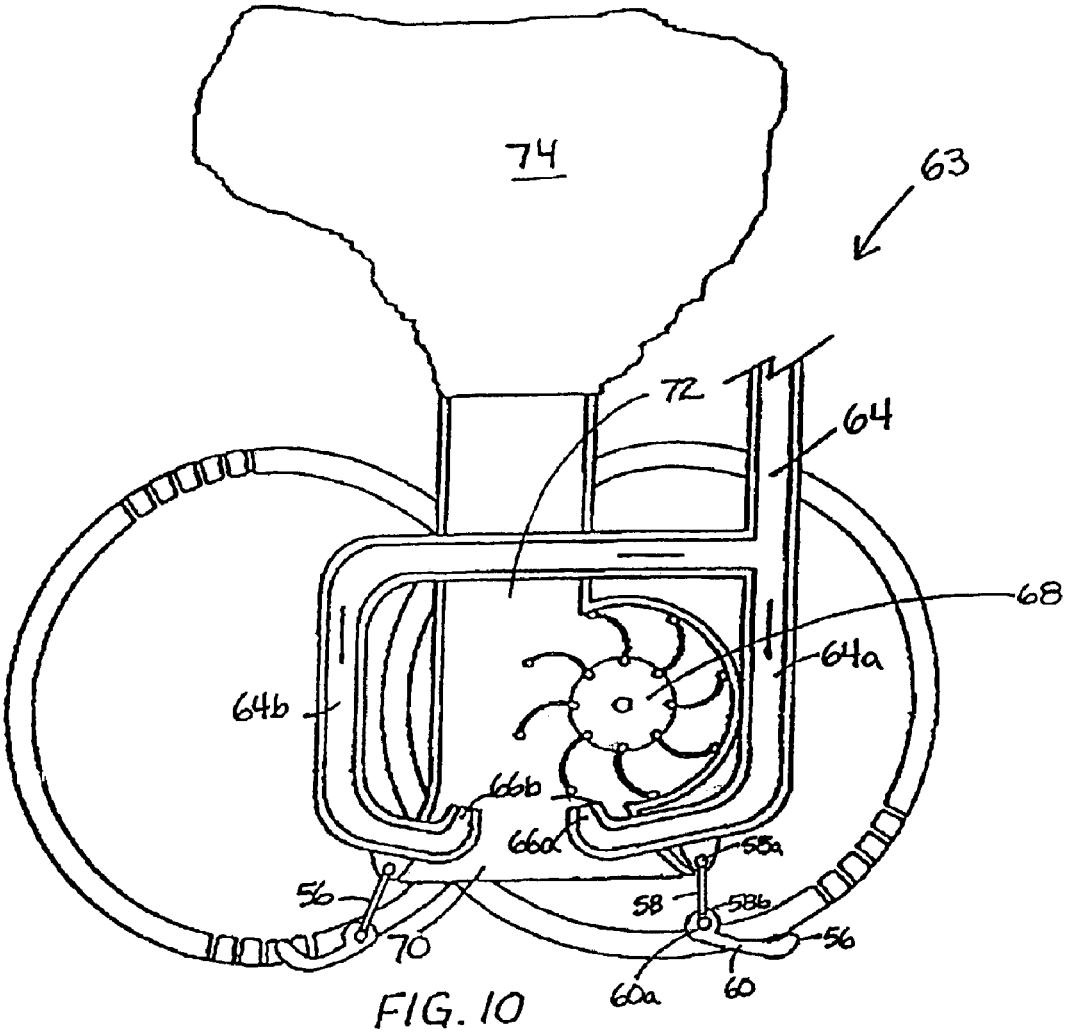
FIG. 10 is a schematic sectional side elevation illustrating portions of another embodiment of the invention, a swimming pool pressure cleaner.

While pool cleaner 20 is a suction cleaner, an alternative pool cleaner 63, which is a pressure cleaner, is shown in FIG. 10. Pressure cleaner 63 has a turbine 68 and related portions which differ from their counterparts in pool cleaner 20. Pressure cleaner 63, instead of operating by harnessing the suction of water through a pool cleaner, operates by harnessing a positive flow of water to a pool cleaner through a pool cleaner hose (not shown), which is attached to a swiveling hose coupling (not shown). The water from the hose flows through conduits 64 and conduit branches 64*a* and 64*b*, and ultimately through venturi jets 66*a* and 66*b* into turbine 68. It should be remembered that FIG. 10 is schematic; it omits a number of parts and does not purport to show the location or the structure providing conduits for flow of water from the hose to the venturi jets.

As shown in FIG. 10, turbine 68 has a larger inlet 70 facing the pool surface (not shown) than is used in pool cleaner 20, described above. Venturi jets 66*a* and 66*b* are located at or near inlet 70 and are oriented to direct water upwardly into inlet 70 and toward outlet 72. The venturi jets, particularly venturi jet 66*a*, are located to cause rotation of the rotor of turbine 68 to provide driving and steering power for pressure cleaner 63. A venturi action caused by venturi jets 66*a* and 66*b* draws water and debris from beneath pool cleaner 63 into inlet port 70, and causes such water and debris to flow upwardly through turbine 68 and outlet port 72 into a collection bag 74, which acts as a filter.

The venturi action is caused by the accelerated flow of water created by jets 66*a* and 66*b*. The accelerated flow of water creates a pressure differential which causes an upward suction of water and debris from adjacent on the pool surface into inlet 70. Thus, the venturi jets serve two purposes—driving the turbine and creating an upward flow from beneath the pool cleaner for cleaning purposes. The size and orientation of venturi jets 66*a* and 66*b* not only cause these actions, but serve to facilitate an essentially quick straight-line movement of debris into collection bag 74.

In every other respect, pressure cleaner 63 is like suction cleaner 20.

Referring again to pool cleaner 20 of FIGS. 1–9, the following is a description of the manner in which the rotation of rotor 48 is transmitted to drive wheels 22*a–d*. FIG. 6 is particularly helpful in illustrating the drive train and its three different portions. The three different portions include: (1) a first portion which extends from a first drive gear 76, affixed to rotor 48, to left and right front wheels 22*a* and 22*b*; (2) a second portion which extends from front wheel 22*a* to rear wheel 22*c*; and (3) a third portion which extends from front wheel 22*b* to rear wheel 22*d*. (The second and third portions of the drive train are identical to each other.) All four wheels are driven by first drive gear 76; a second drive gear 78, which is affixed to the opposite side of rotor 48, is used to control the steering of pool cleaner 20. (First and second drive gears 76 and 78 are integrally formed with rotor 48 and are affixed to a rotor shaft 79 which is rotatably mounted with respect to body 24.)

The first drive train portion includes left and right drive shafts 80 and 82, sometimes referred to herein as "first" and "second" drive shafts. Drive shafts 80 and 82 are aligned end-to-end. The first drive train portion also has a gear train including gears 84*a*, 84*b* and 84*c*. Gear 84*c* serves as a coupler to receive the proximal ends 80*a* and 82*a* of drive shafts 80 and 82. (Proximal end 80*a* of drive shaft 80 forms a balljoint coupling with coupling gear 84*c*, for steering purposes described below.) Drive shafts 80 and 82 terminate at their distal ends in pinion gears 86*a* and 86*b*, which are integrally formed with the shafts. Gears 86*a* and 86*b* engage primary wheelgears 32 of drive train wheels 22*a* and 22*b*, respectively. Thus, the rotation of rotor 48 causes synchronous rotation of front drive wheels 22*a* and 22*b*, each in the same direction.

The rotation of front drive wheels 22*a* and 22*b* causes rotation of rear drive wheels 22*c* and 22*d*, by means of the second and third portions of the drive train, which will now be described. Each of these identical drive-train portions end up engaging primary (or final) wheelgear 32 of one of rear drive wheels 22*c* and 22*d*. Adjacent to each rear wheel is a transfer shaft 88 which is journaled in body 24 by means of appropriate bearings. The opposite ends of each transfer shaft 88 include pinion gears 90*a* and 90*b*, which are formed as part of transfer shaft 88. Each pinion gear 90*a* engages primary wheelgear 32 of one of front drive wheels 22*a* or 22*b*, at a position spaced about 180° from the point of engagement of pinion gear 86*a* or 86*b* therewith. Each pinion gear 90*b* engages primary (or final) wheelgear 32 of one of rear drive wheels 22*c* and 22*d*.

The operation of the steering mechanism will now be described. Left drive shaft 80, which is generally in exact axial alignment with right drive shaft 82, can be moved off-axis by virtue of the ball-joint at its proximal end 80*a*. More specifically, pinion gear 86*a*, which is formed at the distal end of left drive shaft 80, is movable in fore-and-aft directions depending upon forces applied to drive shaft 80, as hereafter described. FIG. 7 shows an oblong opening 92 in a portion of body 24 which accommodates such movement of left drive shaft 80.

Pool cleaner 20 includes a shift bracket assembly 94 which is slidably held within a cavity 96 formed in body 24.

Left drive shaft 80 is journaled by suitable bearing means in shift bracket assembly 94. Shift bracket assembly 94 includes a roller 98 at its rearward end for engagement by a cam wheel 100 which serves the purpose of controlling the position of shift bracket assembly 94, either fore or aft. A spring 102 is located within cavity 96 in a position between a fixed surface of body 24 and the forward end of shift bracket assembly 94. Spring 102 biases shift bracket assembly 94 into firm engagement with cam wheel 100.

Since left drive shaft 80 is journaled in shift bracket assembly 94, the position of pinion gear 86*a* is determined by the fore-or-aft position of shift bracket assembly 94. In the forward position, pinion gear 86*a* engages primary wheelgear 32 of left front wheel 22*a;* in the rearward position, it engages secondary wheelgear 34 of left front wheel 22*a*. Left front wheel 22*a* moves in a forward direction when pinion gear 86*a* engages primary wheelgear 32; however, since the reverse side of pinion gear 86*a* is what engages secondary wheelgear 34 when pinion gear 86*a* is in the aft position, such engagement results in reverse rotation of left front wheel 22*a*. And, by virtue of the driving linkage between left front wheel 22*a* and left rear wheel 22*c,* the aft position of pinion gear 86*a* also reverses the rotational direction of left rear drive wheel 22*c*. In other words, the periodic movement of shift bracket assembly 94 moves left drive shaft 80 and its pinion gear 86*a* to the aft position, and this interrupts the synchronous rotation of the drive wheels and causes turning of pool cleaner 20.

A major portion of cam wheel 100 has a fixed radius sufficient to allows cam wheel 100 to hold shift bracket assembly 94 in a forward position. Cam wheel 100 also has one or more smaller portions of lesser radius which allow shift bracket assembly 94 to move to its aft position under the biasing force of spring 102.

Cam wheel 100 is rotatably supported on an extension 104 of rotor shaft 79 at a position spaced from rotor 48. Also rotatably supported on extension 104 are several gear members of a reduction gear assembly 106, the purpose of which is to reduce rotational speed such that cam wheel 100 turns slowly—at a rate such that its portions of greater or lesser radial dimension dwell in contact with roller 98 of shift bracket assembly 94 for reasonable periods of time. More specifically, the gearing and cam design are such that the pool cleaner 20 will move in a forward position most of the time, and only intermittently change directions for short periods of time.

Figure 8:
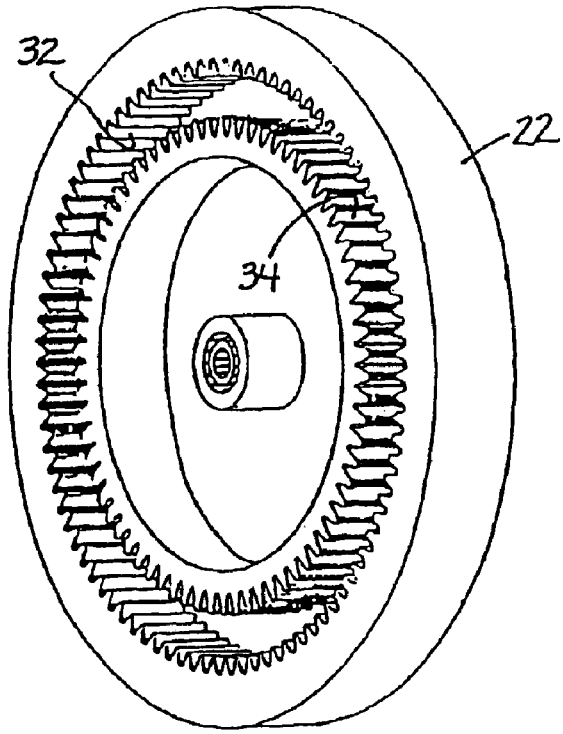
FIG. 8 is a perspective of one of the drive wheels, with its annular tread piece removed.

Primary and secondary wheelgears 32 and 34 are integrally formed with each of the drive wheels 22*a–d*. FIG. 8 illustrates the main portion of one such drive wheel, with its tread piece removed.

Figure 9:
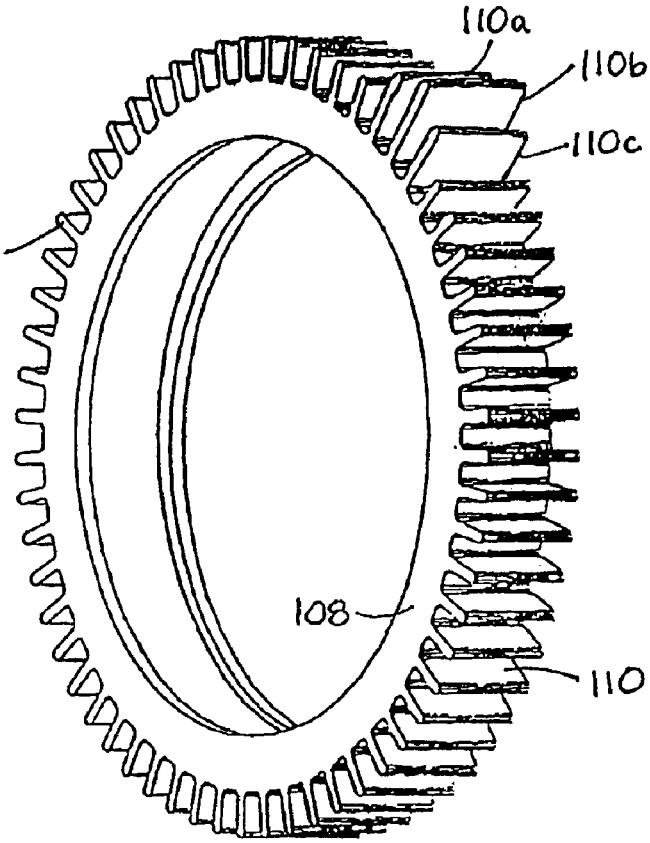
FIG. 9 is a perspective of the tread piece.

FIG. 9 illustrates a resilient elastomeric tread element 108 which is shaped for firm engagement about the periphery of the main portion of each drive wheel and to provide good traction. Tread element 108 has many outwardly extending resilient radial fingers 110. These tread features on the drive wheels of the present invention provide increased traction on slippery surfaces. This tread in combination with the large size of the drive wheels, which are essentially as large in diameter as the pool cleaner is high, allows the cleaner to ride over commonly encountered impediments and obstacles in the pool environment, including main drains, pool liner wrinkles, and uneven, convex and concave surfaces. Such drive wheels in the four-wheel-drive pool cleaner of this invention also allow the pool cleaner to navigate a vertical wall which joins a pool bottom surface without any curved transition (or "radius").

While elastomeric flexible treads are normally best, in certain applications, notably involving submerged tile surfaces, it may be preferable to fit the drive wheels with synthetic foam treads. When foam tread is used, effective grip and suction can be maintained on even the most slippery submerged inclined and vertical tile surfaces.

As shown in FIG. 9, three consecutive radial fingers 110*a–c* project radially farther than the others. As explained above, this serves to provide additional traction for dislodgement of the pool cleaner 20, if needed. Radial finger 110*b* extends slightly farther than radial fingers 110*a* and 110*c*.

Most of the parts of the pool cleaners of this invention may be formed using rigid plastic parts, as is well known in the art. Suitable materials for all of the parts would be apparent to those skilled in the art who are made familiar with this invention.

While the principles of this invention have been described in connection with specific embodiments, it should be understood clearly that these descriptions are made only by way of example and are not intended to limit the scope of the invention.

We claim:

1. In a trackless automatic pool cleaner of the type motivated by the flow of water therethrough to move along a pool surface to be cleaned, the pool cleaner having four wheels each in trackless direct contact with the pool surface, the improvement comprising:

a body having a front side, a rear side and opposite sides, the wheels being rotatably mounted with respect to the body and including first and second sets of two wheels each, each set including one of the wheels on each side of the body;

a turbine housing secured to the body and having a water-flow chamber formed by a chamber wall, the chamber having inlet and outlet ports;

a turbine rotor rotatably mounted in the chamber;

turbine vanes having proximal edges connected to the rotor and distal edges freely movable at all rotational positions thereabout between extended positions adjacent to the wall and retracted positions spaced farther from the wall and closer to the rotor, thereby to allow passage of debris pieces of substantial size through the turbine; and a drive train from the rotor to the first set of wheels and to the second set of wheels for trackless driving of all four wheels;

whereby all four wheels are driven.

2. The device of claim 1 wherein the drive train includes:

a first drive-train portion from the drive member to the first set of wheels;

a second drive-train portion from one wheel of the first set of wheels to one wheel of the second set of wheels; and a third drive-train portion from the other wheel of the first set of wheels to the other wheel of the second set of wheels.

3. The device of claim 1 wherein the wheels have treads directly thereon with a multiplicity of outwardly extending radial fingers spaced around the entire circumferences thereof.

4. The device of claim 3 wherein a small subset of the radial fingers project radially farther than the other fingers, thereby to provide traction for dislodgement purposes.

5. The device of claim 1 wherein the pool cleaner is a suction cleaner.

6. The device of claim 1 wherein the pool cleaner is a pressure cleaner.

7. In an automatic pool cleaner of the type motivated by the flow of water therethrough to move along a pool surface to be cleaned, the pool cleaner having four wheels in contact with the pool surface, the improvement comprising:

a body having a front, a rear and opposite sides the wheels being rotatably mounted with respect to the body and including first and second sets of two wheels each, each set including one of the wheels on each side of the body;

a turbine housing secured to the body and having a water-flow chamber formed by a chamber wall, the chamber having inlet and outlet ports;

a turbine rotor rotatably mounted within the water-flow chamber for rotation by the flow of water;

turbine vanes having proximal edges pivotably connected to the rotor and distal edges movable with respect thereto between extended positions which are adjacent to the wall and retracted positions which are spaced farther from the wall and closer to the rotor, thereby to allow passage of debris pieces of substantial size through the turbine; and a drive train from the drive member to the first and second sets of wheels whereby all four wheels are driven, the drive train including:

a first drive-train portion from the drive member to the first set of wheels;

a second drive-train portion from one wheel of the first set of wheels to one wheel of the second set of wheels; and a third drive-train portion from the other wheel of the first set of wheels to the other wheel of the second set of wheels.

8. The device of claim 7 wherein the vanes are curved and the distal edges of the vanes contact the chamber wall in their extended positions.

9. The device of claim 7 wherein the rotor has an exterior surface beneath which, for each vane, is a corresponding cavity which pivotably holds the proximal edge of the vane.

10. The device of claim 9 wherein the vanes have enlargements at their proximal edges sized for free insertion into, and pivotable engagement in, the cavities.

11. In an automatic pool cleaner of the type motivated by the flow of water therethrough to move along a pool surface to be cleaned, the pool cleaner having four wheels in contact with the pool surface, the improvement comprising:

a body having a front, a rear and opposite sides, the wheels being rotatably mounted with respect to the body and including first and second sets of two wheels each, each set including one of the wheels on each side of the body;

a drive mechanism secured with respect to the body in position to be moved by the flow of water through the pool cleaner, the drive mechanism including a rotatable drive member; and a drive train from the drive member to the first and second sets of wheels whereby all four wheels are driven, the drive train including:

a first drive-train portion from the drive member to the first set of wheels;

a second drive-train portion from one wheel of the first set of wheels to one wheel of the second set of wheels; and a third drive-train portion from the other wheel of the first set of wheels to the other wheel of the second set of wheels, and wherein:

each of the wheels has an inward side and an outward side;

a first wheel of the first set has radially-spaced primary and secondary wheelgears thereon facing one another on the inward side thereof;

a second wheel of the first set has another primary wheelgear on the inward side thereof, the primary wheelgears being similar to one another; and the first drive-train portion terminates at the first and second wheels of the first set in first and second drive pinions, respectively, each engaging the primary wheelgear of the respective wheel;

thereby to drive the first set of wheels in the forward direction.

12. The device of claim 11 wherein the wheelgears of the first wheel of the first set are integrally formed with the first wheel, and are concentric.

13. The device of claim 12 wherein the wheelgear of the second wheel of the first set is integrally formed with the second wheel.

14. The device of claim 13 wherein the first and second wheels of the first set are identical, whereby they are interchangeable.

15. The device of claim 11 wherein:

each of the wheels of the second set has a final wheelgear on the outward side thereof; and each of the second and third drive-train portions includes:

a transfer shaft journaled with respect to the body;

a first transfer pinion engaged with one of the primary wheelgears; and a second transfer pinion engaged with one of the final wheelgears;

whereby rotation of the first set of wheels causes rotation of the second set of wheels.

16. The device of claim 15 wherein each transfer shaft forms the first and second transfer pinions at opposite ends thereof.

17. The device of claim 16 wherein the wheelgears of the first wheel of the first set are integrally formed with the first wheel, and are concentric.

18. The device of claim 17 wherein the wheelgear of the second wheel of the first set is integrally formed with the second wheel.

19. The device of claim 18 wherein all four of the wheels are identical, whereby they are interchangeable.

20. The device of claim 15 wherein:

the drive member is a drive gear; and the first drive-train portion includes:

first and second drive shafts journaled with respect to the body and having proximal and distal ends;

the first and second drive pinions being driven by the first and second drive shafts, respectively; and a gear train from the drive gear to the first and second drive shafts.

21. The device of claim 20 wherein the first and second drive shafts form the first and second drive pinions, respectively, at the distal ends thereof.

22. The device of claim 21 wherein the first drive-train portion includes a coupler with opposite ends receiving the proximal ends of the first and second drive shafts.

23. The device of claim 22 wherein the proximal end of the first drive shaft is a ball joint allowing the distal end of the first drive shaft to be moved fore-and-aft between a driving position in which the first drive pinion engages the primary wheelgear of the first wheel of the first set and a steering position in which the first drive pinion engages the secondary wheelgear of the first wheel of the first set, thereby causing the first wheel to rotate in a direction opposite that of the second wheel of the first set so that the direction of movement of the pool cleaner is changed.

24. The device of claim 23 further including apparatus for fore-and-aft movement of the distal end of the first drive shaft, comprising:

a shift bracket assembly slidably held by the body, the first drive shaft being journaled therein for movement of its distal end between the driving and steering positions;

a cam wheel rotatably secured with respect to the body and engaging the shift bracket assembly, the cam wheel having portions of greater and lesser radii;

a reduction gear assembly secured with respect to the body and linking the drive mechanism with the cam wheel such that rotation of the cam wheel is related to rotation of the drive member; and a spring biasing the shift bracket toward the cam wheel; whereby the cam wheel, acting through the shift bracket assembly, alternately holds the distal end of the first drive shaft in the driving position and allows the distal end of the first drive shaft to move to the steering position.

25. The device of claim 24 wherein the wheels have treads with a multiplicity of outwardly extending radial fingers.

26. The device of claim 25 wherein a small subset of the radial fingers project radially farther than the other fingers, thereby to provide traction for dislodgement purposes.

27. In an automatic pool cleaner of the type motivated by the flow of water therethrough to move along a pool surface to be cleaned, the pool cleaner having four wheels in contact with the pool surface, the improvement comprising:

a body having a front, a rear and opposite sides, the wheels being rotatably mounted with respect to the body and including first and second sets of two wheels each, each set including one of the wheels on each side of the body;

a drive mechanism secured with respect to the body in position to be moved by the flow of water through the pool cleaner, the drive mechanism including a rotatable drive member and a water inlet facing the pool surface and supported by the wheels in close proximity to the pool surface;

a skirt secured with respect to the body and extending toward the pool surface such that the skirt and the body, together with the pool surface, form a plenum from which water and debris are drawn into the inlet, the skirt including at least one flap member having upper and lower articulating portions, the upper articulating portion having a proximal end hinged to the body and a distal end hinged to the lower articulating portion; and a drive train from the drive member to the first set of wheels and to the second set of wheels;

whereby all four wheels are driven.

28. The device of claim 27 wherein the skirt is segmented in that it comprises a plurality of the articulated flap members in side-by-side arrangement, thereby to facilitate relative enclosure of the plenum despite encountered irregularities in the pool surface immediately under the pool cleaner.

29. The device of claim 28 wherein the pool cleaner is a suction cleaner.

* * * * *